US005356107A

United States Patent [19]

Sinohuiz

[11] Patent Number: 5,356,107

[45] Date of Patent: Oct. 18, 1994

[54] BEVERAGE CONTAINER HOLDER

[76] Inventor: David M. Sinohuiz, 83 153 Circle Dr., Indio, Calif. 92201

[21] Appl. No.: 93,467

[22] Filed: Jul. 19, 1993

[51] Int. Cl.[5] ..... A47K 1/08

[52] U.S. Cl. ..... 248/311.2; 248/230; 297/188

[58] Field of Search ..... 248/311.2, 312, 314, 248/230, 309.1, 231.2; 220/737, 738; 297/188, 184

[56] References Cited

U.S. PATENT DOCUMENTS

| | | | |
|---|---|---|---|
| D. 324,975 | 3/1992 | Miller | D7/607 |
| 2,995,333 | 8/1961 | Pazzano | 248/314 X |
| 3,559,869 | 2/1971 | Reynolds | 229/31 |
| 3,881,677 | 5/1975 | Ihlenfeld | 248/311.2 |
| 4,063,701 | 12/1977 | Wray | 248/311.2 X |
| 4,164,851 | 8/1979 | Bryant | 62/381 |
| 4,596,370 | 6/1986 | Adkins | 348/311.2 |
| 4,697,780 | 10/1987 | Wenkman et al. | 248/311.2 X |
| 4,721,276 | 1/1988 | Moss | 248/311.2 |
| 4,798,413 | 1/1989 | Capelli | 297/188 X |
| 4,799,638 | 1/1989 | Allen | 297/188 X |
| 4,932,225 | 6/1990 | Bighouse | 62/457.4 |
| 5,009,377 | 4/1991 | Mangeruga | 248/231.8 X |
| 5,022,235 | 6/1991 | Grissom | 62/457.4 |
| 5,238,212 | 8/1993 | Dechellis | 248/311.2 |

*Primary Examiner*—Ramon O. Ramirez

*Attorney, Agent, or Firm*—Rhodes & Ascolillo

[57] ABSTRACT

A beverage container holder capable of being attachable to a chair or the like, the beverage container holder including a beverage container holder member for holding the beverage container, the beverage container holder member having a substantially cylindrical chamber having one open circular face, a supporting strut, an attaching member for attaching the beverage container holder member to the supporting strut, a mounting member for mounting the supporting strut to the chair, the mounting member being an elastically deformable sleeve-shaped hollow cylindrical clamping member having a longitudinal cutout. Preferably, the supporting strut is a substantially rhomboidal rigid supporting strut permanently affixed to, and projecting obliquely from, the clamping member. The attaching member is preferably a generally U-shaped and substantially vertically oriented channel permanently affixed to an exterior surface of the cylindrical chamber, the U-shaped channel having an open end, the open end of the channel facing away from the open circular face. The attaching member additionally includes a pin permanently affixed to the substantially rhomboidal strut, the pin being removably and slidingly engageable with the U-shaped channel. The beverage container holder member preferably includes at least one layer of a thermally insulating material.

3 Claims, 3 Drawing Sheets

BEVERAGE CONTAINER HOLDER

BACKGROUND

1. Field of the Invention

The present invention relates to the field of beverage container holders, particularly beverage container holders that attach to a chair or the like.

2. Description of the Related Art

Many beverage containers are roughly cylindrical in shape, as are the variety of beverage container holders. Beverage container holders may additionally be designed to keep the beverage container and its contents at a temperature cooler than the ambient environment. This may be accomplished by providing thermally insulative layers, cooling fluids, handles, motorized cooling mechanisms, or the like. These beverage container holders are typically handheld or placed on a fiat surface such as a table or the ground.

U.S. Des. Pat. No. 324,975 shows a thermal cooler for beverage cans which simulates the appearance of a golf bag.

U.S. Pat. No. 3,559,869 discloses a beverage cooler formed by folding seamless corrugated paper into an open container that holds beverage containers.

U.S. Pat. No. 4,164,851 relates a beverage container cooler that includes a cooling compartment and a motorized gear mechanism which rotates a beverage container and maintains rolling frictional contact between the beverage container and ice, both of which are placed inside the cooling compartment, thereby reducing the temperature of the beverage container and its contents.

U.S. Pat. No. 4,932,225 also relates a beverage container cooler that includes a roughly cylindrical container, a lid, a latch for the lid, a handle, and a plurality of pouches containing a refreezable cooling fluid that surround the beverage container cavity.

U.S. Pat. No. 5,022,235 discloses a beverage cooler apparatus having two cup-shaped supports, one fitting inside the other, formed of thermally insulative foam-like material, including a complementary pair of diametrically aligned recesses adjacent the open face of both supports which provide drinking access or finger access to a container placed inside the inner supports.

SUMMARY OF THE INVENTION

In one aspect, the invention generally features a beverage container holder capable of being attachable to a chair or the like, the beverage container including: a supporting strut; a beverage container holder member for holding the beverage container; an attaching member for attaching the beverage container holder member to the supporting strut; and a mounting member for mounting the supporting strut to the chair.

Preferably, the mounting member is an elastically deformable sleeve-shaped hollow cylindrical clamping member having a longitudinal cutout; the supporting strut is a substantially rhomboidal rigid strut permanently affixed to, and projecting obliquely from, the clamping member; and the beverage container holder member is a substantially cylindrical chamber having one open circular face.

In one embodiment, the attaching member is a generally U-shaped and substantially vertically oriented channel permanently affixed to an exterior surface of the cylindrical chamber, the U-shaped channel having an open end, the open end of the channel facing away from the open circular face. The attaching member additionally includes a pin permanently affixed to the substantially rhomboidal strut, the pin being removably and slidingly engageable with the U-shaped channel. The beverage container holder member additionally includes at least one layer of a thermally insulating material.

In another embodiment, the attaching member includes a rim extending radially outward from and encircling at least a portion of the substantially cylindrical exterior surface adjacent the open circular face; an annular member having an inner diameter substantially smaller than the rim and substantially greater than the diameter of the substantially cylindrical surface, so that the beverage container holder member slidably and removably engages the annular member, and wherein the annular member additionally is permanently affixed to an edge of the substantially rhomboidal strut opposite to the clamping member.

In another aspect, the invention generally features a beverage container holder capable of being removably attachable to a substantially vertical chair member, and the beverage container holder including: a holder member having a substantially cylindrical exterior surface; a substantially cylindrical and upwardly facing cavity provided in the holder member; an annular rim extending radially outward from the substantially cylindrical exterior surface adjacent an upper edge of the holder member; a semicylindrical clamping member dimensioned to partially encircle the chair member; a strut member extending obliquely upward from the clamping member; and an annular ring extending substantially horizontally outward from the strut member.

In yet another aspect, the invention generally features a beverage container holder for holding a beverage container, the beverage container holder capable of being removably attachable to a substantially vertical chair member, the beverage container holder including: a holder member having a substantially cylindrical exterior surface; a substantially cylindrical and upwardly facing cavity provided in the holder member; a downwardly facing channel provided on the substantially cylindrical exterior surface of the holder member; a semicylindrical clamping member dimensioned to partially encircle the chair member; a strut member extending obliquely upward from the clamping member; and a pin member slidingly engaging the channel, the pin member being disposed on an upper and outward edge of the obliquely extending strut member.

One object of the present invention is to provide a convenient place to rest a beverage container that is within reach of its user.

Another object is to keep the contents of the beverage container cool by preventing contact of the beverage container with relatively warm surfaces such as beach sands, table tops, or human hands.

Yet another object of this invention is to provide a sturdy support which easily accepts beverage containers and which can be readily mounted and demounted from pole-like objects without the use of tools or clamps.

Still another object is to prevent accidental spillage of the contents of a beverage container by providing a fixed resting place that is not susceptible to jarring.

Another object of the invention is to provide a new and improved beverage container holder that is durable, simple to use, and inexpensive to manufacture and sell.

The invention will now be described by way of a particularly preferred embodiment, reference being made to the accompanying drawings, wherein:

DESCRIPTION OF THE PREFERRED EMBODIMENT

Figure 1:
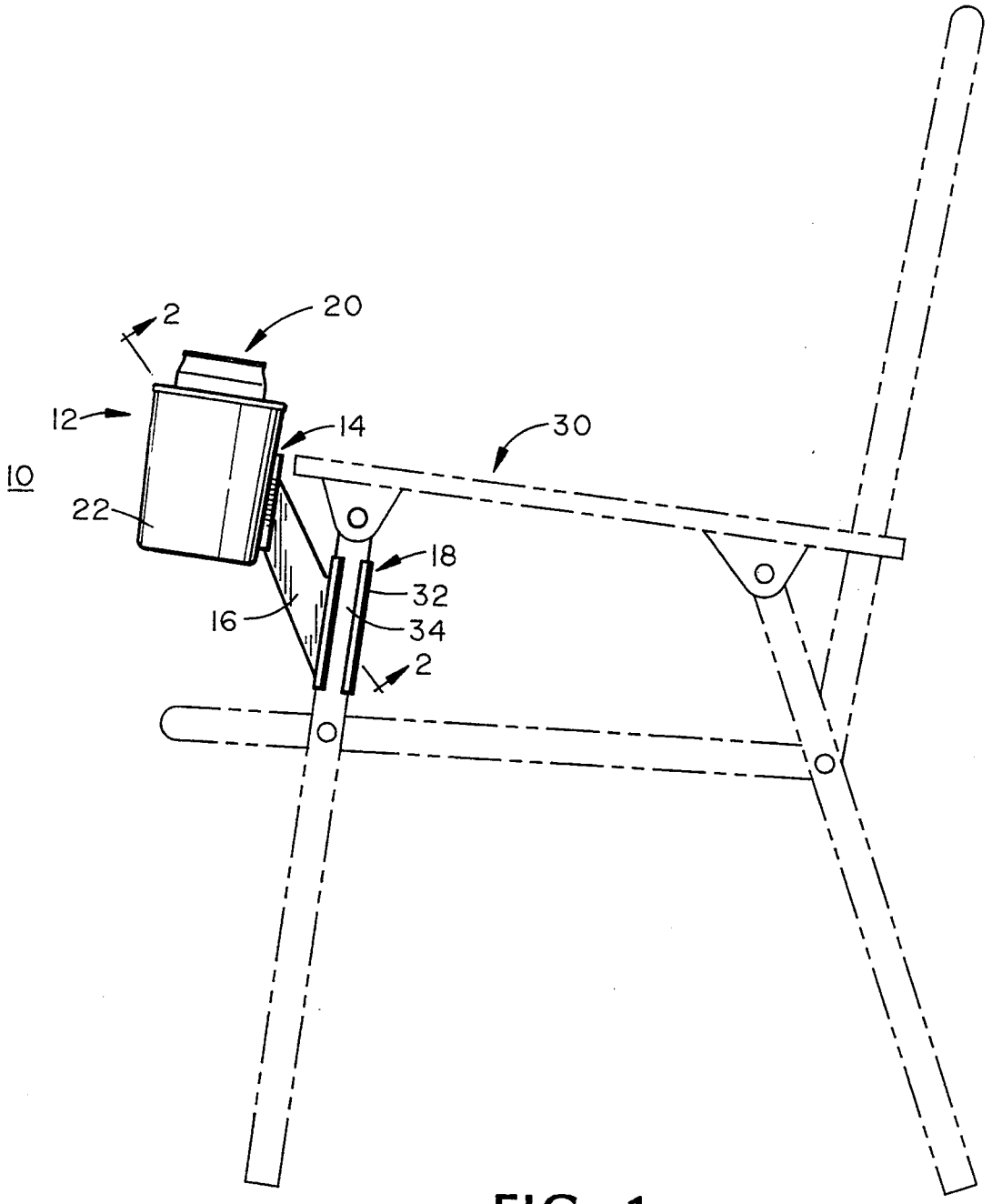
FIG. 1 is a side elevational view of a beverage container holder according to the present invention mounted to a chair, for example, a lawn chair, and holding a beverage container, for example, a soft drink can, the beverage container and the chair being shown for illustrative purposes only.

Referring now most particularly to FIG. 1, a beverage container holder 10 constructed according to the present invention generally includes a beverage container holder member 12 for holding the beverage container 20, a supporting strut 16, an attaching member 14 for attaching the beverage container holder member 12 to the supporting strut 16, and a mounting member 18 for mounting the supporting strut 16, for example, to a chair 30.

Figure 2:
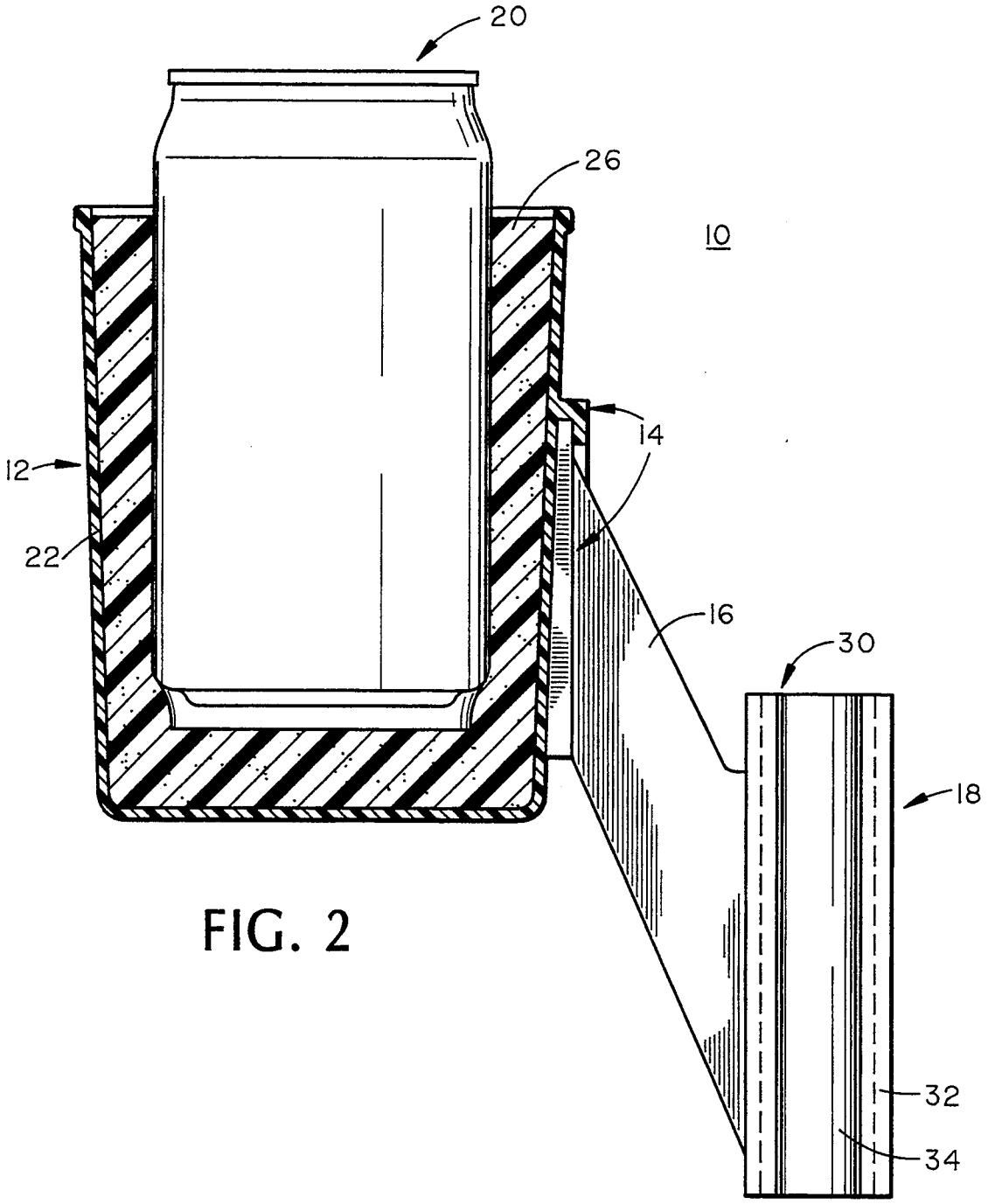
FIG. 2 is a longitudinal cross sectional view of the beverage container holder, along the lines indicated in FIG. 1, and showing a beverage container, for example a soft drink can, positioned inside a thermally insulated cup-shaped support, the soft drink can being shown for illustrative purposes only.
Figure 3:
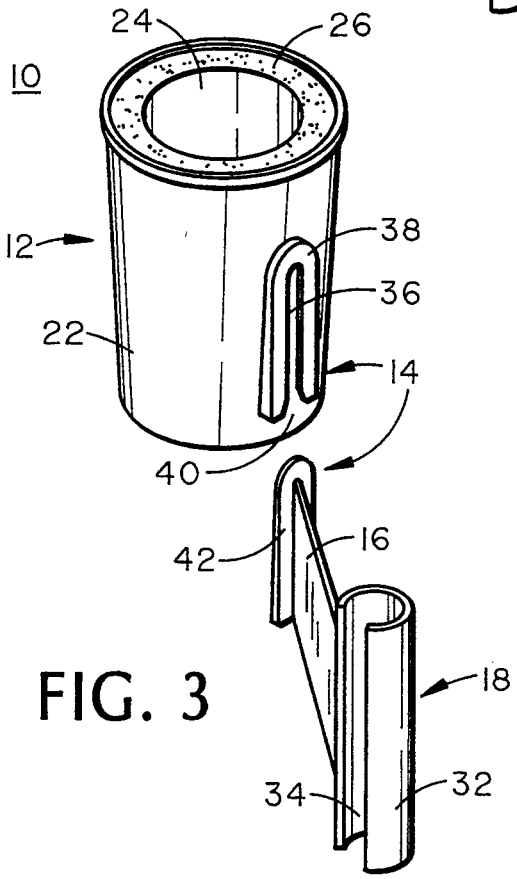
FIG. 3 is an isometric view of the beverage container holder set forth in FIGS. 1 and 2, showing a cup-shaped support separated from a supporting strut, the cup-shaped support having an internal thermally insulative layer.
Figure 4:
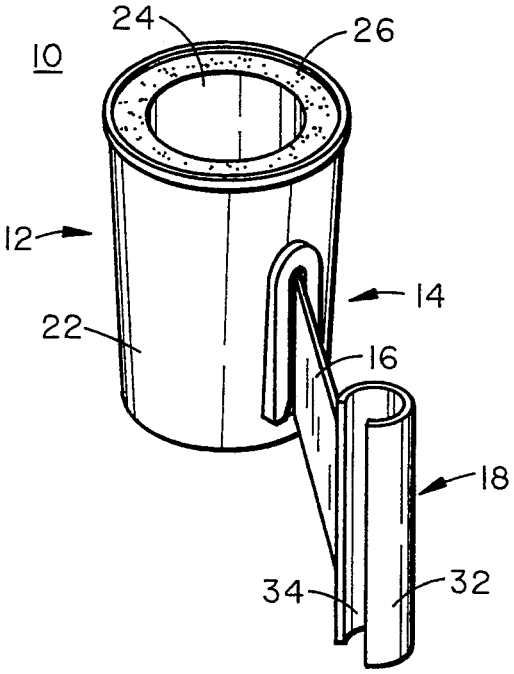
FIG. 4 is an isometric view of the beverage container holder set forth in FIGS. 1, 2, and 3 showing the cup-shaped support having an internal thermally insulative layer interlocked with the supporting strut.

Referring to all of FIGS. 1–4, it will been seen that the beverage container holder member 12 is preferably a substantially cylindrical chamber 22 having one open circular face 24. As seen in FIGS. 2–4, the beverage container holder member preferably includes at least one layer of a thermally insulating material 26.

Referring again to FIGS. 1–4, it will also be seen that the mounting member 18 includes an elastically deformable sleeve-shaped hollow cylindrical clamping member 32 having a longitudinal cutout 34. The supporting strut 16 is preferably a substantially rhomboidal rigid strut permanently affixed to, and projecting obliquely from the clamping member 32.

As best seen in FIG. 3, the preferred embodiment of the attaching member 14 includes a generally U-shaped vertically oriented channel 38 permanently affixed to an exterior surface of the cylindrical chamber 22, the U-shaped channel 38 having an open end 40, which faces away from the open circular face 24 of the cylindrical chamber 22. The preferred embodiment of the attaching member 14 additionally includes a pin 42 permanently affixed to the substantially rhomboidal supporting strut 16, the pin 42 being removably and slidingly engageable with the U-shaped channel 40.

Figure 5:
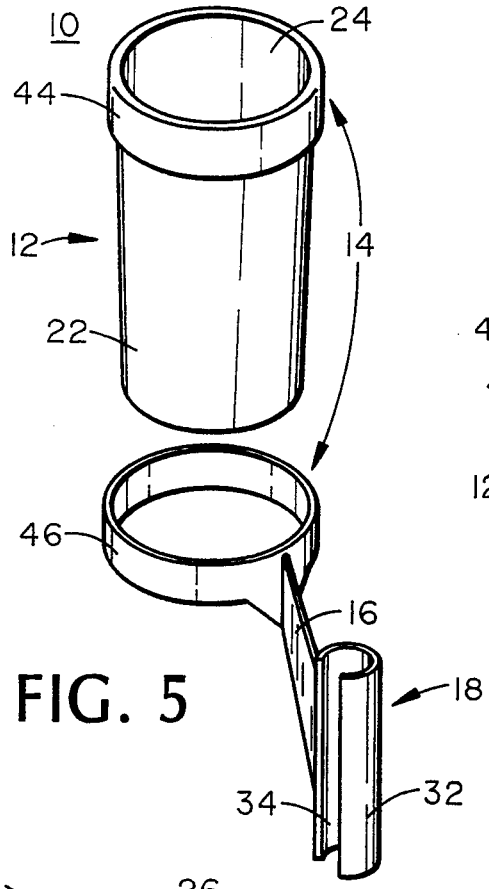
FIG. 5 is an isometric illustration of an alternative embodiment of the inventive beverage container holder, showing a cup-shaped support separated from a supporting strut.
Figure 6:
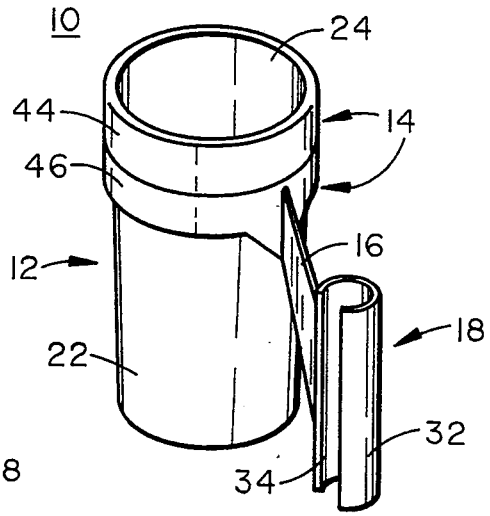
FIG. 6 is an isometric view of the beverage container holder set forth in FIG. 5, showing the cup-shaped support interlocked with the supporting strut.

An alternative embodiment of the attaching member 14 is shown in FIGS. 5 and 6, like reference numerals being used to identify elements similar to those already discussed above, wherein the attaching member 14 generally includes a rim 44 extending radially outward from and encircling a portion of the exterior surface of the cylindrical chamber 22 adjacent the open circular face 24. The attaching member 14 additionally includes an annular member 46 which has an inner diameter substantially smaller than the rim 44 and substantially greater than the outer diameter of the cylindrical chamber 22. The cylindrical chamber 22 slidably and removably engages the annular member 46, and the annular member 46 is permanently affixed to an edge of the substantially rhomboidal strut 16 opposite to the edge that is affixed to the clamping member 18.

While the invention has been herein described by way of a particular preferred embodiment, various substitutions of equivalents may be effected without departing from the spirit and scope of the invention as set forth in the following claims.

What is claimed is:

1. A beverage container holder for holding a beverage container, said beverage container holder being removably attachable to a substantially vertical chair member, said beverage container holder comprising:

a holder member;

said holder member having a substantially cylindrical exterior surface;

a substantially cylindrical and upwardly facing cavity provided in said holder member;

an annular rim extending radially outward from said substantially cylindrical exterior surface adjacent an upper edge of said holder member;

a semicylindrical clamping member dimensioned to partially encircle the chair member;

a strut member extending obliquely upward from said clamping member; and an annular ring extending substantially horizontally outward from said strut member.

2. A beverage container holder for holding a beverage container, said beverage container holder being removably attachable to a substantially vertical chair member, said beverage container holder comprising:

a holder member;

said holder member having a substantially cylindrical exterior surface;

a substantially cylindrical and upwardly facing cavity provided in said holder member;

a downwardly facing channel provided on said substantially cylindrical exterior surface of said holder member;

a semicylindrical clamping member dimensioned to partially encircle the chair member;

a strut member extending obliquely upward from said clamping member; and a pin member slidingly engaging said channel, said pin member being disposed on an upper and outward edge of said obliquely extending strut member.

3. A beverage container holder for holding a beverage container, said beverage container holder being attachable to a chair, said beverage container comprising:

(a) a supporting strut comprising a substantially rhomboidal rigid strut;

(b) a beverage container holder means for holding the beverage container comprising:

a substantially cylindrical chamber having one open circular face;

a substantially cylindrical exterior surface; and at least one layer of a thermally insulating material;

(c) an attaching means for attaching said beverage container holder means to said supporting strut, said attaching means comprising:

a rim extending radially outward from and encircling at least a portion of said substantially cylindrical exterior surface, wherein said rim encircles an edge of said cylindrical exterior surface adjacent said open circular face;

an annular member, said annular member having an inner diameter substantially smaller than said rim and substantially greater than the diameter of said substantially cylindrical surface;

a generally U-shaped and substantially vertically oriented channel permanently affixed to an exterior surface of said cylindrical chamber, said U-shaped channel having an open end, said open end of said channel facing away from said open circular face; and a pin permanently affixed to said substantially rhomboidal strut, said pin being removably and slidingly engageable said U-shaped channel; and (d) a mounting means for mounting said supporting strut to the chair, said mounting means comprising an elastically deformable sleeve-shaped hollow cylindrical clamping member having a longitudinal cutout, wherein said substantially rhomboidal rigid strut is permanently affixed to, and projecting obliquely from, said clamping member;

whereby said beverage container holder means slidably and removably engages said annular member, and wherein said annular member additionally is permanently affixed to an edge of said substantially rhomboidal strut opposite to said clamping member.

* * * * *